US007572215B2

(12) United States Patent
Kayhan et al.

(10) Patent No.: US 7,572,215 B2
(45) Date of Patent: Aug. 11, 2009

(54) ROLL

(75) Inventors: Menderes Kayhan, Tumba (SE); Jimmy Ankargren, Ärsta (SE)

(73) Assignee: Sandvik Intellectual Property AB, Sandviken (SE)

( * ) Notice: Subject to any disclaimer, the term of this patent is extended or adjusted under 35 U.S.C. 154(b) by 478 days.

(21) Appl. No.: 11/447,307

(22) Filed: Jun. 6, 2006

(65) Prior Publication Data

US 2006/0287177 A1 Dec. 21, 2006

(30) Foreign Application Priority Data

Jun. 17, 2005 (SE) ..... 0501385

(51) Int. Cl.
*F16C 13/00* (2006.01)

(52) U.S. Cl. ..... 492/40; 492/39; 492/60

(58) Field of Classification Search ..... 492/40, 492/39, 47, 1, 38, 45, 60; 29/895.213, 895.22
See application file for complete search history.

(56) References Cited

U.S. PATENT DOCUMENTS 776,796 A * 12/1904 Perkins ..... 492/40
978,080 A * 12/1910 Vieser ..... 101/375
1,540,588 A * 6/1925 Alexander ..... 492/38
4,577,674 A * 3/1986 Harada et al. ..... 164/448
4,932,111 A 6/1990 Kark
5,103,759 A * 4/1992 Henseler et al. ..... 118/118
5,155,910 A * 10/1992 Henseler et al. ..... 29/895.213
5,257,965 A * 11/1993 Fuchs et al. ..... 492/6
5,483,812 A 1/1996 Dempsey
5,735,788 A 4/1998 Yasutake et al.
6,685,611 B1 2/2004 Kark
6,896,646 B2 * 5/2005 Kaiser et al. ..... 492/40
2006/0287176 A1 * 12/2006 Gleizer et al. ..... 492/47

FOREIGN PATENT DOCUMENTS

DE 2528157 7/1976
EP 0343440 B1 11/1989
EP 1733812 A1 * 12/2006

* cited by examiner

*Primary Examiner*—Essama Omgba
(74) *Attorney, Agent, or Firm*—Drinker Biddle & Reath LLP

(57) ABSTRACT

A combi roll comprising a roll shaft and a roll ring mounted on the same against which at least one other ring is axially pressed, such as a spacer ring, the contact surfaces of the rings pressed against each other serving as torque-transferring friction joints. In the individual interface between two end contact surfaces there is distributed a great number of small grains of a material harder than the hardest material of anyone of the rings, the grains having the purpose of partially penetrating into each one of the contact surfaces so as to increase the torque-transferring ability of the friction joint.

6 Claims, 1 Drawing Sheet

ROLL

FIELD OF THE INVENTION

The present invention relates to a combi roll comprising a roll shaft and a roll ring mounted on the same against which at least one other ring is axially pressed, end contact surfaces of the rings pressed against each other serving as torque-transferring friction joints.

BACKGROUND OF THE INVENTION

Generally, combi rolls include two or more roll rings, which are kept separated by intermediate spacer rings, the entire set of rings being kept fixed on the roll shaft by way of, on one hand, a fixed stop ring, e.g., a shoulder of the roll shaft and, on the other hand, a lock nut, which via an internal thread may be tightened on a male thread of the shaft. Furthermore, between the lock nut and the set of roll rings and spacer rings, respectively, springs as well as additional rings may be present.

In many cases, the roll rings are manufactured from a hard material, such as cemented carbide, while intermediate spacer rings are manufactured of a softer or more ductile material, preferably steel or cast iron. Considerable torque should be transmitted from the roll shaft to the roll rings. When the roll rings exclusively are made of cemented carbide, the transmission of torque usually takes place by an axial (cylindrical) train of forces from the lock nut to the fixed stop ring via the end contact surfaces between the individual rings. More precisely, the torque is transmitted from the individual ring to an adjacent ring by friction action in those interfaces where an end surface of a ring is pressed against a co-operating end surface of the adjacent ring. In order to manage this purpose throughout the train of forces, the individual interfaces or friction joints between the rings have to be powerful, i.e., be able to transmit torque without the rings slipping in relation to each other.

In previously known combi rolls (see, for instance, U.S. Pat. Nos. 5,735,788 and 6,685,611), the end surfaces of the individual interfaces are metallic in so far as the surfaces have been generated by machining, such as turning and/or grinding, of a metal blank that should form the individual ring. In other words, the end surfaces of a spacer ring of steel are steel surfaces, while the end surfaces of cemented carbide roll ring are a cemented carbide surfaces. Dependent on the surface finish and the nature of the different materials, the friction between such surfaces may become inferior, something that may lead to the rings slipping in relation to each other. Another shortcoming of previously known combi rolls is that the roll rings as well as the spacer rings are formed with end surfaces that extend radially all the way from the inside of the ring to the outside thereof, i.e., from the envelope surface of the roll shaft to the external cylinder surface of the individual ring. This design of the end surfaces results in transmission of torque in a zone situated approximately halfway between the inside and the outside of the spacer ring, i.e., relatively near the envelope surface of the roll shaft. Furthermore, the surface pressure in the interfaces between the end contact surfaces will be fairly low because the contact surfaces are comparatively large.

SUMMARY

The present invention aims at obviating the above-mentioned disadvantages of previously known combi rolls and at providing an improved roll. Therefore, a primary object of the invention is to provide a combi roll in which large torque may be transmitted between adjacent rings via friction joints that in a reliable way counteract slipping between the rings. In other words, the invention aims at providing powerful and efficient friction joints between the rings of the roll. It is also an object to provide the improved friction joints by simple elements.

According to a first aspect, a roll comprises a roll shaft and a roll ring mounted on the roll shaft, against which ring at least one other ring is axially pressed, end contact surfaces of the rings being pressed against each other and serving as torque-transmitting friction joints. In the interface between the contact surfaces, there is distributed a large number of small grains of a material that is harder than the hardest material in any one of the rings, the grains having the purpose of partially penetrating into each one of the contact surfaces.

DETAILED DESCRIPTION

Figure 1:
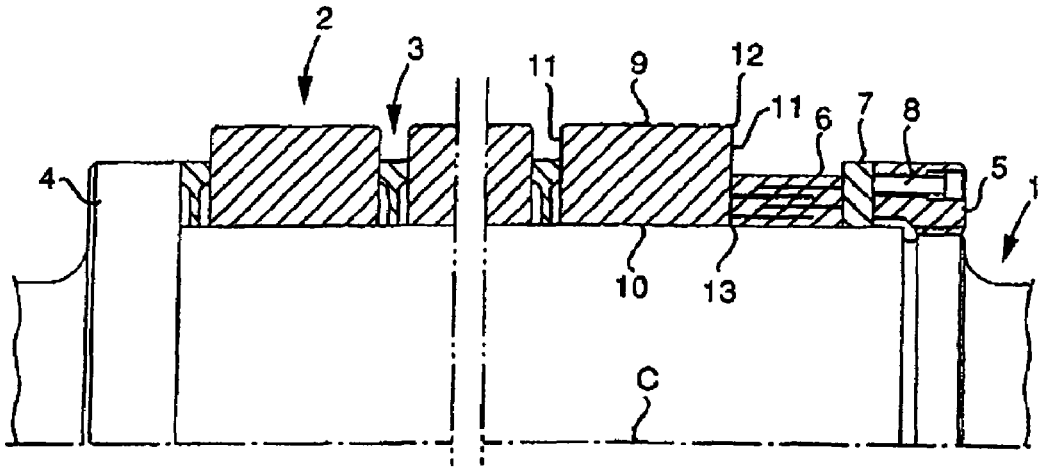
FIG. 1 is a partly cut longitudinal view through a combi roll according to the invention.

In FIG. 1, a roll is shown that includes a drivable roll shaft 1, a number of roll rings 2, and a number of spacer rings 3. The roll shaft 1 has a rotationally symmetrical basic shape defined by a center axis C.

The set of rings 2, 3 is kept in place between a fixed stop ring 4, which in the example is in the form of a ring-shaped shoulder, and a lock nut 5 at the opposite end of the shaft. The lock nut 5 has an internal thread (not shown), which may be tightened on an external thread of the roll shaft. Between the lock nut 5 and the first roll ring 2, there is in this case also a dynamic spring 6, which is separated from the lock nut by a ring 7. Furthermore, in the lock nut, there are a number of peripherically spaced-apart adjusting devices 8, by way of which the spring force of the spring 6 may be adjusted.

In the example, the roll rings 2 are assumed to be composed of solid cemented carbide, while the spacer rings 3 consist of a softer metal, e.g., steel. Each individual roll ring 2 is delimited by, on one hand, external and internal cylinder surfaces 9, 10 and, on the other hand, opposite end surfaces 11, each one of which is planar and extends perpendicularly to the center axis C. Each end surface 11 is limited outwardly by an outer, circular edge line 12, and inwardly by an inner, circular edge line 13.

Figure 2:
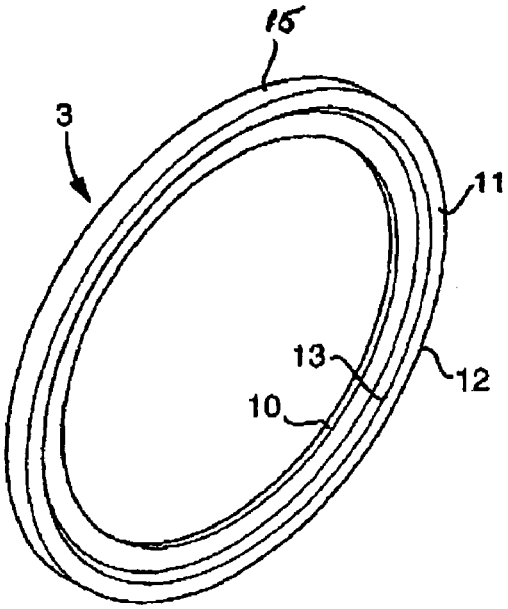
FIG. 2 is a perspective view of a spacer ring included in the roll.

In an analogous way, the individual spacer ring 3 (see FIG. 2) is delimited by an external cylinder surface 15 that determines the outer diameter of the ring, an internal cylinder surface or hole edge surface 10 that determines the inner diameter of the ring, as well as two opposite planar end surfaces 11 that are ring-shaped and extend perpendicularly to the center axis C.

Figure 3:
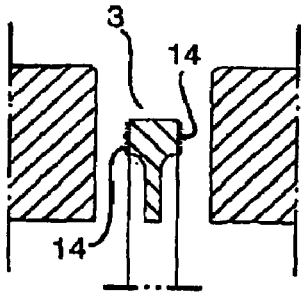
FIG. 3 is an enlarged detailed section showing a spacer ring separated from two roll rings before being urged against these.

According to an aspect of the invention, the individual interface between each pair of end contact surfaces 11, being pressed against each other, there is distributed a large number of small grains of a material that is harder than the hardest material of anyone of the rings. The grains are advantageously dispersed in a viscous fluid, e.g., a paste. In FIG. 3, three rings are shown spaced-apart from each other, on the end contact surfaces 11 of the spacer ring 3, a thin layer 14 of a paste being shown, which contains hard grains, and which has been applied to the surface in a suitable way, e.g., by painting. Alternatively, the hard grains may be applied using plating technique.

Figure 4:
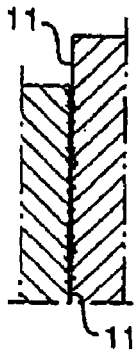
FIG. 4 is an extremely enlarged section showing a part of the interface between the contact surfaces of the rings.

When the rings 2, 3, by way of the lock nut 5 and the adjusting devices 8, are pressed against each other by full force, the grains included in the paste will partially penetrate into each one of the end contact surfaces 11, such as is shown in FIG. 4. The individual grains will then serve as diminutive, mechanical bridges between the contact surfaces and in such a manner radically improve the torque-transmitting ability of the friction joint.

The grains in the interface shall have an average grain size of 10-125 μm, preferably 25-100 μm. Suitably, coarser grains are used when the contact surfaces are rough.

In the present case, when the roll rings consist of cemented carbide, the grains may advantageously be diamond, cubic boron nitride, ceramics or the like.

In accordance with a preferred embodiment of the invention, the individual spacer ring 3 (see FIG. 2) has been formed in such a way that the inner limiting edge line 13 of the individual end surface 11 is greater than the outer diameter of the roll shaft, i.e., greater than the diameter of the hole edge surface 10. In such a way, the total area of the end surface 11 for a given outer diameter is reduced, whereby the surface pressure against the end surface of an adjacent roll ring is increased. Furthermore, the force transmission zone, i.e., an imaginary circular line about halfway between the edge lines 12, 13, is moved outwardly in comparison with the corresponding force transmission zones in previously known spacer rings. In other words, the efficient torque arm increases, such as this is determined by the radial distance between the center axis C and the force transfer zone.

The presently disclosed embodiments are considered in all respects to be illustrative and not restrictive. The scope is indicated by the appended claims, rather than the foregoing description, and all changes that come within the meaning and range of equivalents thereof are intended to be embraced.

The invention claimed is:

1. A roll, comprising:

a roll shaft and a roll ring mounted on the roll shaft, against which ring at least one other ring is axially pressed, end contact surfaces of the rings being pressed against each other and serving as torque-transmitting friction joints, wherein a large number of small grains of material are distributed in the interface between the contact surfaces, the material of the small grains being harder than a material of any of the rings, the grains being partially embedded in the rings through adjacent contact surfaces of the rings.

2. The roll according to claim 1, wherein said grains are dispersed in a viscous fluid prior to being partially embedded into the rings.

3. The roll according to claim 1, wherein the average grain size of the grains in the interface is 10-125 μm.

4. The roll according to claim 1, wherein the average grain size of the grains in the interface is 25-100 μm.

5. The roll according to claim 1, wherein the roll ring is manufactured from cemented carbide, and that the grains are a material selected from the group comprising diamond, cubic boron nitride or ceramics.

6. The roll according to claim 1, wherein at least one of the end surfaces of a spacer ring is limited by an inner edge, the diameter of which is greater than the outer diameter of the roll shaft.

* * * * *